US007075234B2

(12) United States Patent
Shiokawa et al.

(10) Patent No.: US 7,075,234 B2
(45) Date of Patent: Jul. 11, 2006

(54) PANEL THAT DISCHARGES A PLURALITY OF CELLS ON A PAIR OF LINE ELECTRODES

(75) Inventors: Akira Shiokawa, Osaka (JP); Ryuichi Murai, Toyonaka (JP); Yuusuke Takada, Katano (JP); Katutoshi Shindo, Higashiosaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 255 days.

(21) Appl. No.: 10/470,259

(22) PCT Filed: Feb. 12, 2002

(86) PCT No.: PCT/JP02/01128

§ 371 (c)(1),
(2), (4) Date: Jul. 23, 2003

(87) PCT Pub. No.: WO02/065502

PCT Pub. Date: Aug. 22, 2002

(65) Prior Publication Data

US 2004/0056595 A1 Mar. 25, 2004

(30) Foreign Application Priority Data

Feb. 14, 2001 (JP) ..... 2001-037221

(51) Int. Cl.
*H01J 17/49* (2006.01)

(52) U.S. Cl. ..... 313/582; 313/631; 313/491

(58) Field of Classification Search ..... 313/582–587, 313/491, 631

See application file for complete search history.

(56) References Cited

U.S. PATENT DOCUMENTS

| | | | | |
|---|---|---|---|---|
| 6,384,532 | B1 * | 5/2002 | Yoshioka et al. | 313/586 |
| 6,433,477 | B1 | 8/2002 | Ha et al. | |
| 6,650,053 | B1 * | 11/2003 | Takada et al. | 313/586 |
| 2001/0024921 | A1 | 9/2001 | Hirano et al. | |

FOREIGN PATENT DOCUMENTS

| | | |
|---|---|---|
| JP | 3187125 | 8/1991 |
| JP | 0096715 | 4/1996 |
| JP | 8315734 | 11/1996 |
| JP | 9167565 | 6/1997 |
| JP | 11233026 | 8/1998 |
| JP | 2000243299 | 9/2000 |
| JP | 2001236889 | 8/2001 |
| WO | 00/70643 | 11/2000 |
| WO | WO 200156052 A1 * | 8/2001 |

* cited by examiner

*Primary Examiner*—Vip Patel
*Assistant Examiner*—Anthony T. Perry

(57) ABSTRACT

A discharge panel capable of high-quality display by preventing erroneous discharge between adjacent lines in a sustaining electrode or the like. A sectional shape in a direction orthogonal to the longitudinal directions of both a first display electrode (101*a*) and a second display electrode (101*b*) has a stepped shape, a film thickness of a discharge gap (Gap1) side portion is greater than that on a non-discharge gap side, the film thickness of the respective steps being specified as L1, L2, L3 (L1>L2>L3). Accordingly, a discharge start voltage on the discharge gap side is lower than that on the non-discharge gap side even when the discharge gap and the non-discharge gap have the same width geometrically, thereby reducing erroneous discharge between adjacent cells positioned on an adjacent lines.

18 Claims, 14 Drawing Sheets

PANEL THAT DISCHARGES A PLURALITY OF CELLS ON A PAIR OF LINE ELECTRODES

TECHNICAL FIELD

The present invention relates to a gas panel or the like of which a plasma display panel is representative and which is used for image display in a computer, a television or the like. In particular, the present invention relates to an improvement in the shape of pairs of line-shaped discharge electrodes that is effective in preventing erroneous discharge.

BACKGROUND ART

Expectations have heightened in recent years regarding high-quality, large-screen displays, such as high vision displays. These expectations are being answered with progress in research and development in fields relating to CRTs, liquid crystal displays (LCDs), plasma display panels (PDPs) and so on.

CRTs, which are conventionally widely-used as displays in televisions, are superior in regard to resolution and picture quality. However, CRTs are not suitable as large-screen displays of 40 inches or more due to the fact that a larger screen size leads to increased depth and weight. Furthermore, LCDs, while being advantageous in terms of low power consumption and avoiding the problems of depth and weight, have a limited viewing angle. This is something that must be improved if large-screen LCDs are to be manufactured.

In contrast, it is relatively easy to make large-screen PDPs even with a shallow depth, and 40-inch class PDPs have already been developed.

PDPs are roughly divided into direct current type (DC type) and alternating current type (AC type), AC type PDPs being the more common of the two due to their suitability as large-screen displays. AC type PDPs are also suitable for high-definition display.

Conventional PDPs generally have a structure such as that shown in FIG. 13. FIG. 13 is a perspective diagram of relevant parts of a PDP.

Generally, in a PDP a front panel PA1 and a back panel PA2 are sealed together at the edges. The front panel PA1 includes a first glass plate 100 on which line-shaped first display electrodes 101*a* and second display electrodes 101*b* are arranged alternately in parallel. A dielectric glass layer 102 made from lead glass covers the first glass plate 100 and the electrodes, and the surface of the dielectric glass layer 102 is covered by an MgO protective layer 103 that is an MgO deposition film or the like.

The back panel PA2 includes a second glass plate 110 on which address electrodes 111 are arranged in parallel in a stripe formation. A dielectric glass layer 112 covers the second glass plate 110 and the electrodes, and barrier ribs 113 are arranged on the surface of the dielectric glass layer 112 in parallel in a stripe formation so as to sandwich the address electrodes. Furthermore, red (R), green (G), and blue (B) phosphor layers 114 are formed between the barrier ribs.

The described front panel PA1 and back panel PA2 are sealed together so that the first and second display electrodes are orthogonal to the address electrodes. Next, discharge gas including xenon, neon, argon and helium is inserted between the front panel PA1 and the back panel PA2.

In the PDP having such a structure, the first display electrodes 101*a* and the second display electrodes 101*b* are provided with discharge gaps (Gap1) therebetween. A part where an adjacent first display electrode 101*a* and second display electrode 101*b* intersect with an address electrode 111 is a discharge cell CL (see FIG. 14 which is a plan diagram showing electrode arrangement).

A conventional PDP uses a display method called field time division display for displaying. In this method, each field is time-divided into a plurality of subfields, and images are displayed according to combinations of light being emitted or not in each sub-field.

In this driving method, image display is performed in each subfield by a series of operations in a plurality of periods: an initialization period, an address period, a sustain period, and an erase period. Specifically, writing is performed in the address period by applying an address pulse to the address electrodes while applying a scan pulse to the first display electrodes, which are scan electrodes. Then, sustained light emission is performed in the sustain period by repeatedly applying a sustain pulse between the first display electrodes and second display electrodes, which are sustain electrodes.

When the structure of the PDP is such that the distance between first and second display electrodes on adjacent lines is equal to the width of the gap between first and second display electrodes on a same line, erroneous discharge occurs easily between adjacent lines, as shown in FIG. 14 (between the i-th line and the i+1-th line). When heightening definition of the PDP, it is inevitable that the width of the gap between display electrodes is narrowed, consequently increasing erroneous discharge.

DISCLOSURE OF THE INVENTION

In order to overcome the described conventional problem, the main object of the present invention is to provide a panel in which high quality image display is possible by preventing erroneous discharge between adjacent lines in the sustain period and other periods.

In order to achieve the stated object, the present invention is a panel that executes discharge in each of a plurality of cells positioned on a pair of line-shaped discharge electrodes, by applying voltage between the discharge electrodes, wherein in at least one cell, at least one of the discharge electrodes has a stepped shape in a cross-sectional view in a direction orthogonal to a longitudinal direction of the discharge electrodes, and in the stepped shape any given step that is closer to a discharge gap than another step is thicker than the other step.

According to this structure, the equivalent film thickness of the dielectric glass layer formed on the discharge electrodes, which are for scanning and sustaining discharge, is different at the discharge gap side and the opposite side (non-discharge gap side). In other words, even if the discharge gap and the non-discharge gap have the same width geometrically, the dielectric layer on one of the electrodes in the pair can be made thinner close to the other electrode in the pair and thicker away from the other electrode in the pair. Consequently, the electrode structure in the present invention is effective in narrowing the non-discharge gap to heighten resolution. Note that "equivalent" refers to the thickness of parts of the dielectric layer positioned on the steps and that actually effect the discharge voltage, taking permittivity into consideration.

Here, it is preferable that difference in thickness between (i) any given step that has a neighboring step on a discharge-gap side and (ii) the neighboring step is greater as a distance becomes further from the discharge gap.

The inventors found that the electric field weakens exponentially in a direction from the discharge gap towards the non-discharge gap, and the diffusion velocity of the priming particles at the discharge gap side slows exponentially in proportion to the weakening of the electric field. Based on this finding, and taking reduction of power consumption into consideration, the above-described structure is thought to be appropriate in terms of specifying the equivalent film thickness of the dielectric glass layer so that the discharge start voltage increases towards the non-discharge gap.

Here, it is preferable that the steps successively increase in width, the widest being furthest from the discharge gap.

Here, it is preferable that difference in width between (i) any given step that has a neighboring step on the discharge-gap side and (ii) the neighboring step is greater as a distance becomes further from the discharge gap.

The inventors found that the electric field weakens exponentially from the discharge gap towards the non-discharge gap. Based on this finding, and taking into consideration capturing of priming particles generated at the discharge gap side, increasing the discharge surface area from the discharge gap to the non-discharge gap, and ensuring a larger effective light emission surface area, it is thought to be appropriate to specify so that the surface area of the step electrodes increases towards the non-discharge gap.

Furthermore, in order to achieve the stated object, the present invention is a panel that executes discharge in each of a plurality of cells positioned on a pair of discharge electrodes, by applying voltage between the discharge electrodes, wherein in at least one cell, at least one discharge electrode is composed of a plurality of separate electrode lines in which any given electrode line that is closer to a discharge gap than another electrode line is thicker than the other electrode line.

According to this structure, the equivalent film thickness of the dielectric glass layer formed on the discharge electrodes, which are for scanning and sustaining, differs at the discharge gap side and the opposite side (non-discharge gap side). In other words, even if the discharge gap and the non-discharge gap have the same width geometrically, the dielectric layer on one of the electrodes in the pair can be made thinner close to the other electrode in the pair and thicker away from the other electrode in the pair. Consequently, the electrode structure in the present invention is effective in narrowing the non-discharge gap to heighten resolution. Note that "equivalent" refers to the thickness of parts of the dielectric layer positioned on the separate electrode lines and that actually effect the discharge voltage, taking permittivity into consideration.

In addition, since the discharge electrodes for scanning and sustaining are separate electrode lines, there is a gap between each separate electrode line, and therefore the amount of emitted light that is reflected or absorbed is reduced. As a result, the aperture ratio of cells is improved, thus enabling emitted light to be brought effectively to the front of the panel.

Here, it is preferable that difference in thickness between (i) any given electrode line that has a neighboring electrode line on a discharge-gap side and (ii) the neighboring electrode line is greater as a distance becomes further from the discharge gap.

Since the electric field weakens exponentially in a direction from the discharge gap towards the non-discharge gap, and the diffusion velocity of the priming particles at the discharge gap side slows exponentially in proportion to the weakening of the electric field, taking reduction of power consumption into consideration, the above-described structure is thought to be appropriate in terms of specifying the equivalent film thickness of the dielectric glass layer so that the discharge start voltage increases towards the non-discharge gap.

Here, it is preferable that the electrode lines successively increase in width, the widest being the furthest from the discharge gap.

Here, it is preferable that difference in width between (i) any given electrode line that has a neighboring electrode line on the discharge-gap side and (ii) the neighboring electrode line is greater as a distance becomes further from discharge gap.

The inventors found that the electric field weakens exponentially from the discharge gap towards the non-discharge gap. Based on this finding, and taking into consideration capturing of priming particles generated at the discharge gap side, increasing the discharge surface area from the discharge gap to the non-discharge gap, and ensuring a larger effective light emission surface area, it is appropriate to specify so that the surface areas of the separate electrode lines of the electrodes are greater towards the non-discharge gap.

Here, it is preferable that separate electrode lines in a same cell that have a same polarity are electrically connected by a connector that is wired at a predetermined interval.

Here, it is preferable that the connector is wired so as to correspond to a position of a barrier rib in the panel.

Here, it is preferable that the connector increases in width in a direction parallel with the discharge electrodes, a widest part being furthest from the discharge gap.

Here, it is preferable that difference in width between (i) any given part of the connector that has a neighboring part on a discharge-gap side and (ii) the neighboring part is greater as a distance becomes further from the discharge gap.

The inventors found that the electric field weakens exponentially in a direction from the discharge gap towards the non-discharge gap, and the diffusion velocity of the priming particles at the discharge gap side slows exponentially in proportion to the weakening of the electric field. Based on this finding, and taking reduction of power consumption into consideration, it is thought to be appropriate to specify so that the discharge start voltage is high by making the resistance of the connector high.

Furthermore, since the electric field weakens in a direction from the discharge gap towards the non-discharge gap, and the brightness of emitted light decreases exponentially in proportion, it is thought to be appropriate to increase the cell aperture ratio in a direction towards the non-discharge gap side, from a point of view of improving brightness.

Here, it is preferable that a thickness of the connector is equal to a thickness of a thinnest of the separate electrode lines having the same polarity as the connector.

Here, it is preferable that gaps between the separate electrode lines are successively greater in width, a narrowest gap being furthest from the discharge gap.

Here, it is preferable that difference in width between (i) any given gap between electrode lines that has a neighboring gap between electrode lines on a discharge-gap side and (ii) the neighboring gap between electrode lines is greater as a distance becomes further from the discharge gap.

This is because it is thought that the greatest amount of light is emitted in the vicinity of the discharge gap, and the inventors found that the electric field weakens exponentially from the discharge gap towards the non-discharge gap, and the luminosity decreases in proportion. Based on this finding, and taking into consideration improvement of luminosity, it is thought to be appropriate to reduce the width of the gaps between the separate electrode lines towards the non-discharge gap, to easily capture priming particles.

BEST MODE FOR CARRYING OUT THE INVENTION

The following describes a PDP as one example of a gas discharge panel in embodiments of the present invention, with reference to the drawings. Note that since the basic structure of the PDP of the present invention is the same as the described conventional PDP, the following omits these details and focuses on the characteristic features of the present invention.

Note that display electrodes are ordinarily formed by layering a backing layer made of ITO and a bus electrode made of metal, but in the present embodiment metal electrodes are used as the display electrodes because they enable electrode lines to be made more finely to comply with higher definition cells, and allow for relatively low electrical resistance.

FIRST EMBODIMENT

Display Electrode Structure

Figure 1:
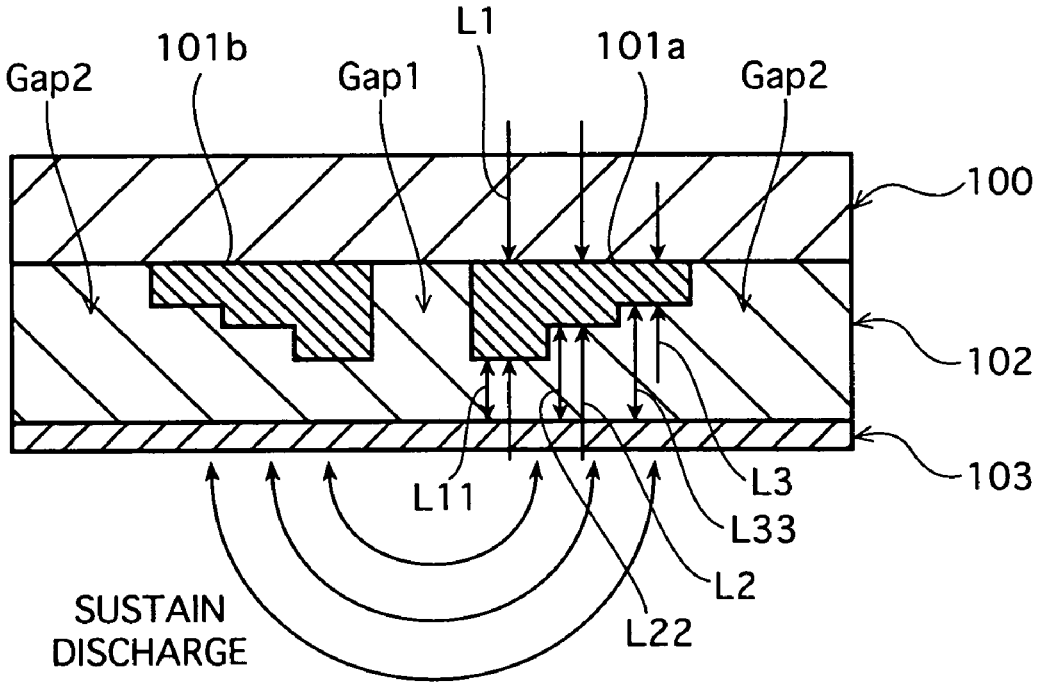
FIG. 1 is an enlarged partial cross-sectional diagram of a front panel of a PDP in a first embodiment.

FIG. 1 is an enlarged partial cross-sectional diagram of the front panel (cut vertically through a center part of a cell) of the PDP of the present embodiment.

As the diagram shows, the cross-sectional shape in a direction orthogonal to the longitudinal direction of each of a first display electrode 101*a* and a second display electrode 101*b* is a stepped shape (three steps in the diagram). The film thickness of the steps in each display electrode is specified as L1, L2, L3, respectively, and a film thickness of a discharge gap Gap1 side portion is greater than that of a non-discharge gap Gap2 side portion. The film thickness of the steps satisfies a relationship L1>L2>L3.

Note that each of film thickness L1 to L3 is the film thickness in a width-wise direction center portion of the particular electrode step.

Electrode Manufacturing Method

Figure 2A:
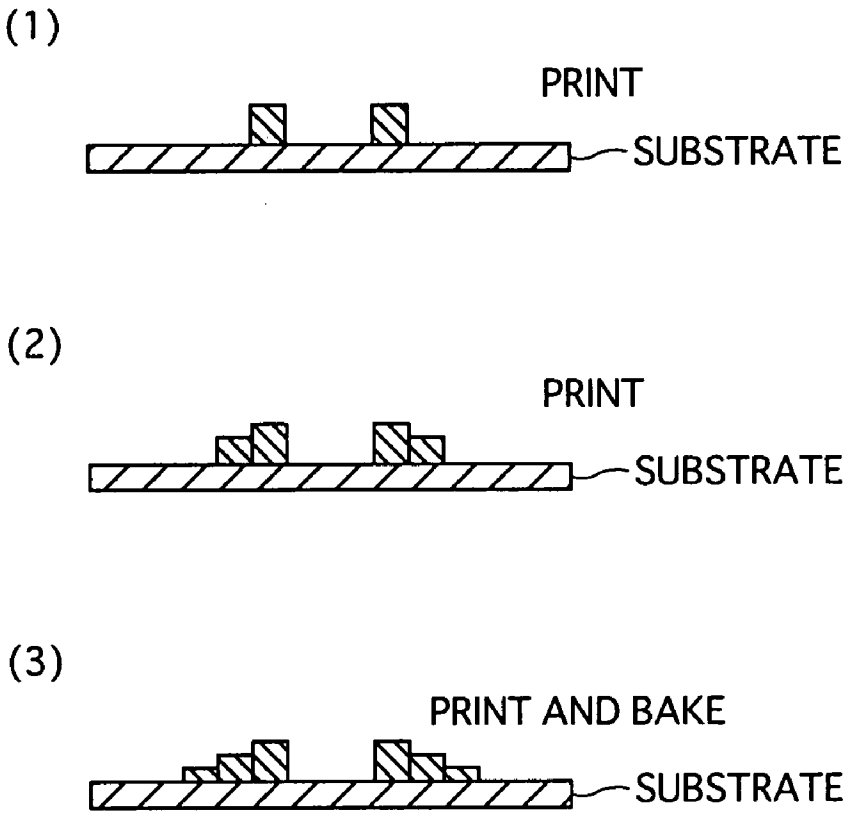
FIG. 2 shows a method for manufacturing first display electrodes and second display electrodes in the first embodiment.
Figure 2B:
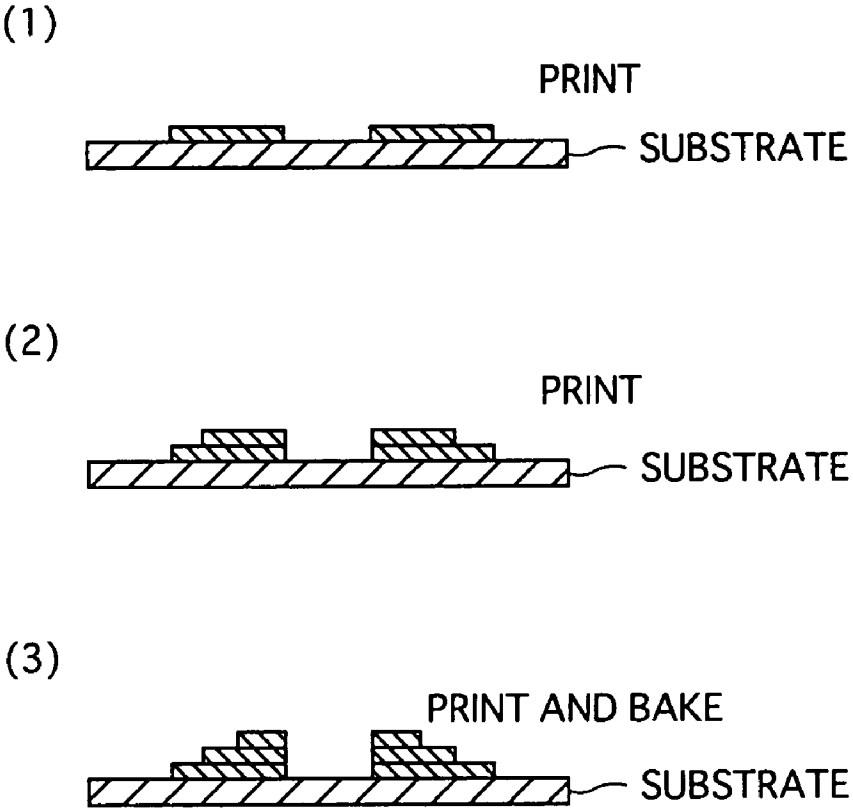

This shape can of course be realized using a commonly-known screen printing method. FIGS. 2A and 2B show a number of processes in methods for forming this shape.

FIG. 2A shows a first method. According to this method, the shape is formed by printing material including metal that makes up the electrode portion of each of the steps of different thickness so that the steps are tightly connected to each other as shown in (1), (2), and (3) of FIG. 2A, and then baking.

FIG. 2B shows a second method. According to this method, the shape is formed by printing in layers the material that makes up the electrodes in steps that differ in width as shown in (1), (2) and (3) in FIG. 2B, and then baking.

Furthermore, although not illustrated, the electrodes can be easily formed by exposing and developing so as to form an appropriate stepped shape.

It is possible to use methods other that those described here.

Working and Effects

According to the described electrode structure, the dielectric glass layer 102 that is formed on the first and second display electrodes, which are scan and sustain discharge electrodes, can be made so that the equivalent film thickness in positions on each of the electrodes from the respective thickest electrode steps through to the respective thinnest electrode steps (corresponding to L11, L22 and L33), differs (L11<L22<L33) at the discharge gap side and the side opposite thereto (the non-discharge gap side). The thinner the dielectric glass layer is, the lower the discharge start voltage is. As a result, even if the discharge gap and the non-discharge gap are geometrically equal in width, erroneous discharge in adjacent cells can be reduced by making the discharge start voltage on the discharge gap side lower than the discharge start voltage on the non-discharge gap side. This realizes an effective electrode structure that heightens definition by narrowing the non-discharge gap.

Specific Examination of Varying the Film Thickness of the Electrode Steps

Figure 3:
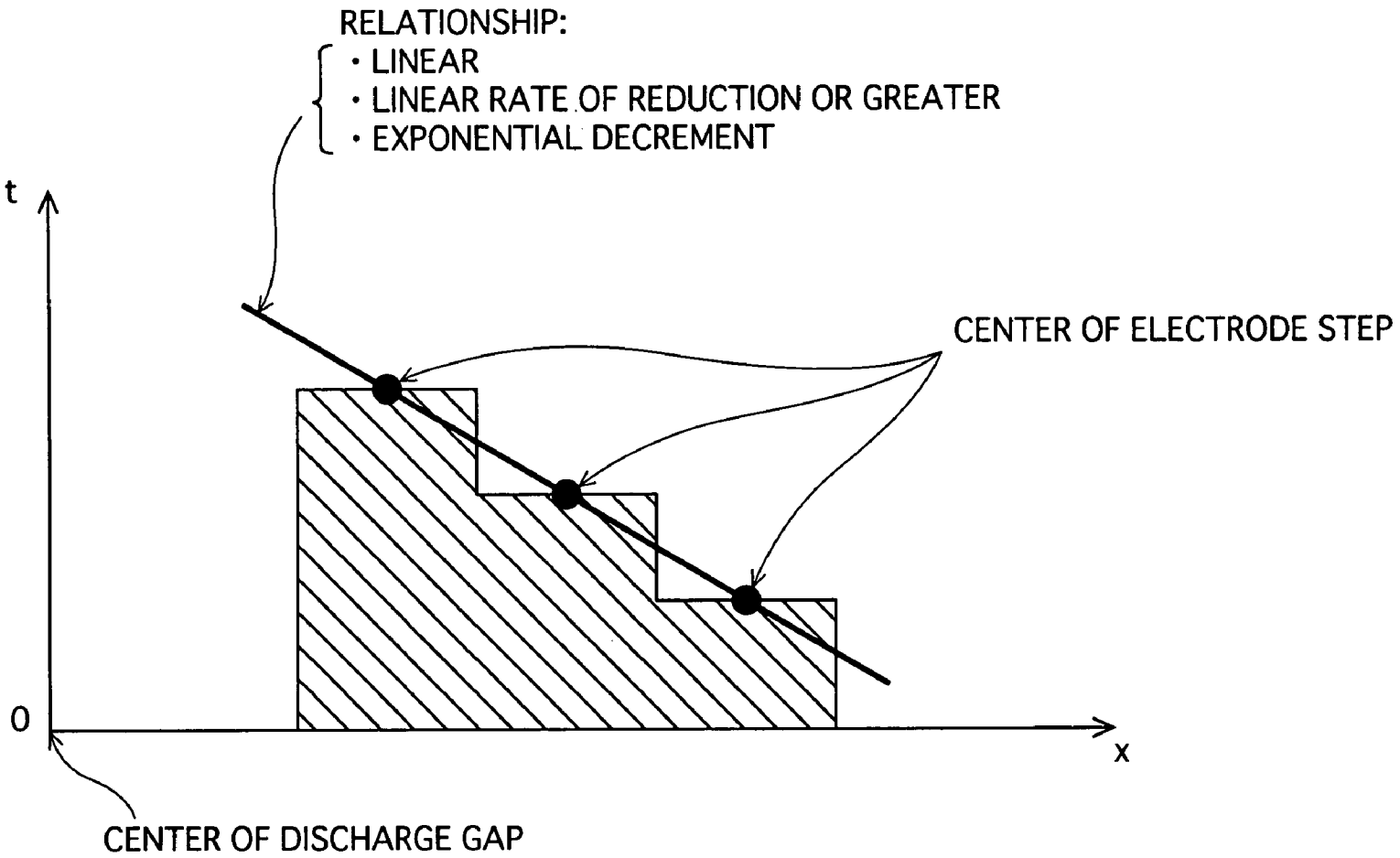
FIG. 3 describes a rate of change of a difference between steps in display electrodes, a horizontal axis (x) representing distance from a discharge gap center, and a vertical axis (t) representing a thickness of each step.

FIG. 3 describes the rate of change of the difference between steps in the display electrodes. The horizontal axis (x) represents the distance from the center of the discharge gap, and the vertical axis (t) represents the film thickness of the electrode steps. As shown in FIG. 3, if correspondence between the distance from the center of the discharge gap and the film thickness of each electrode step is expressed schematically, it is preferable that the rate of reduction of the thickness of the discharge electrodes making the stepped shape is equal to or greater than that shown by the straight line. Here, the correspondence between the distance from the center of the discharge gap and the thickness of the electrodes becomes "equal to the straight line" by specifying in a manner represented by a linear expression ($t=-ax+b$). Furthermore, the correspondence becomes "greater than the straight line" by specifying in a manner represented by an exponential such as ($t=ae^{-bx}$). Here, "rate of change" is expressed as change from a central part of the discharge gap towards the non-discharge gap.

Here, it is preferable that the rate of reduction is an exponential rate of change.

Put another way, the rate of change being in a straight line or being exponential denotes that the thickness of the electrode steps changes linearly or non-linearly.

The essence of specifying the rate of change of the film thickness in order for the thickness of the steps to successively decrease, so that the difference between the film thickness of the front step (the step on a side closest to the discharge gap) and other steps increases successively towards the non-discharge gap.

The reason for specifying the change in the difference between the electrode steps in this way is as follows. Specifically, the inventors found from a simulation experiment using simulation codes such as SI-PDP that the electric field during discharge weakens exponentially in a direction from the discharge gap towards the non-discharge gap, and the diffusion velocity of priming particles that occur at the discharge gap side slows exponentially in proportion. Taking this finding and reduction of power consumption into consideration, it is appropriate to specify so that the discharge start voltage increases towards the non-discharge gap side, by increasing the equivalent film thickness of the dielectric glass layer, in order to prevent erroneous discharge.

Furthermore, the film thickness of the electrode steps is specified taking into consideration the difference in electric potential between the first display electrode and the second display electrode. This is because the greater the electric potential difference, the more easily erroneous discharge occurs between adjacent cells on a line. When, for example, a pulse of 160 to 180V is applied alternately to the first display electrode and the second display electrode, a difference in thickness of approximately 4 to 5 μm between the thicker second step and the less thick third step is effective to prevent erroneous discharge.

Specific Examination of Varying the Width of the Electrode Steps

Figure 4:
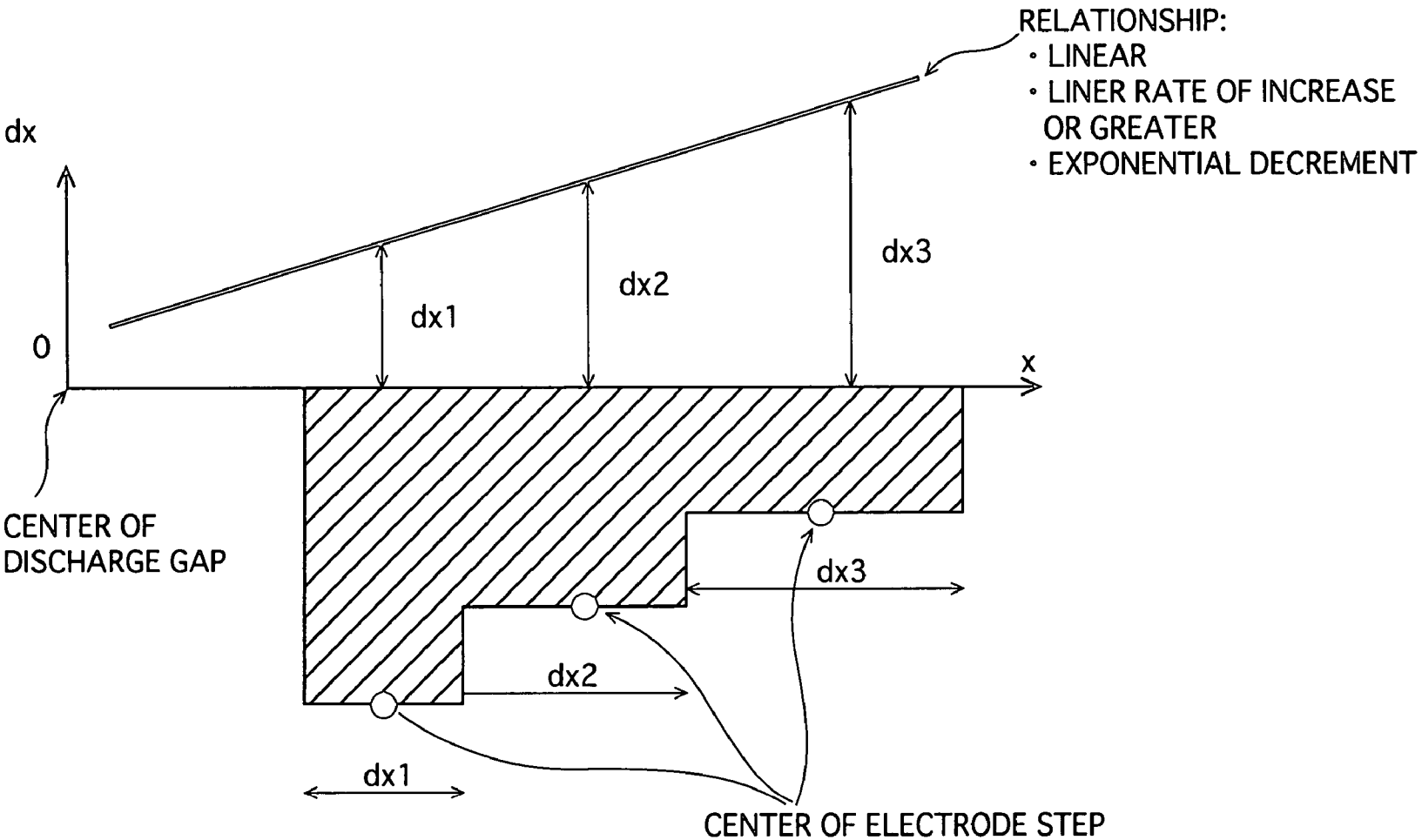
FIG. 4 describes a rate of change of width of steps in display electrodes, a horizontal axis (x) representing distance from a discharge gap center, and a vertical axis (dx) representing a width of each step.

FIG. 4 describes the rate of change of the width of the steps in the display electrodes. The horizontal axis (x) represents the distance from the center of the discharge gap, while the vertical axis (dx) represents the width of each electrode step. As shown in FIG. 4, if correspondence between the distance from the center of the discharge gap and the width of the electrode steps is expressed schematically, it is preferable that the width of each of the steps of first display electrodes and the second display electrodes that make the stepped shapes is larger (wider) the further away the step is from the discharge gap side (satisfying a relationship $dx\mathbf{1}<dx\mathbf{2}<dx\mathbf{3}$).

Furthermore, it is preferable that the width of the electrodes increases at a rate of change that is equal to or greater than that shown by the straight line.

Furthermore, it is preferable that when the width of the electrode steps of the scan and sustain discharge electrodes is greater than the straight line, the rate of reduction is an exponential rate of change.

Put another way, the rate of change being in a straight line or being exponential denotes that the width of the electrode steps changes linearly or non-linearly.

Here, the correspondence between the distance from the center of the discharge gap and the width of the electrode steps is made "equal to the straight line" as shown in FIG. 4 by specifying in a manner represented by a linear expression ($dx=ax+b$). Furthermore, the correspondence is made "greater than the straight line" by specifying in a manner represented by an exponential such as ($dx=ae^{bx}$).

The essence of specifying the rate of change of the width of each electrode step in this way is so that the difference in width with the front step (the step on a side closest to the discharge gap) increases successively towards the non-discharge gap.

The reason for specifying width of the electrode steps in this way is as follows. Specifically, as described above, the electric field during discharge weakens exponentially from the discharge gap towards the non-discharge gap. Therefore, it is thought to be appropriate to specify so that the surface area of each electrode step of the scan and sustain discharge electrodes increase towards the non-discharge gap side in order to capture priming particles generated in the discharge gap side to ensure greater effective light emission surface area.

Implementation Example

Table 1 below shows results of evaluating the degree of erroneous discharge between adjacent lines for various values of the thickness and width of the electrode steps, based on the described embodiment. Here, the degree of erroneous discharge was evaluated as an XT generation voltage value. XT generation voltage is sustain voltage that generates crosstalk, and is a guide for knowing the effectiveness of erroneous discharge prevention because crosstalk occurs less easily when this voltage is high.

TABLE 1

| Panel | Electrode Thickness (μm) | | | Electrode Width (μm) | | | XT Genera- |
|---|---|---|---|---|---|---|---|
| Test Number | 1st Step | 2nd Step | 3rd Step | 1st Step | 2nd Step | 3rd Step | tion Voltage |
| 1 | 8 | 4 | 0.1 | 40 | 60 | 80 | 191 |
| 2 | 8 | 4 | 0.1 | 60 | 60 | 60 | 189 |
| 3 | 7 | 7 | 7 | 40 | 60 | 80 | 179 |
| 4 | 7 | 7 | 7 | 60 | 60 | 60 | |
| (closest to the main gap side) | | | | (closest to the main gap side) | | | |

Note that this evaluation is performed using cut-out samples of 42-type VGA models having 80 μm discharge gaps, a 42 μm dielectric layer and stripe-type 120 μm-high barrier ribs.

As can be seen from these results, having step-shaped electrodes and providing the steps with varying thicknesses and widths, as in panel 1 and panel 2, is effective in preventing erroneous discharge.

SECOND EMBODIMENT

The PDP of the present embodiment differs from the PDP of the previous embodiment in terms of the structure of the first display electrodes and the second display electrodes. Specifically, the main characteristic lies in the steps in each of the first display electrodes and second display electrodes being separated with predetermined intervals therebetween.

Figure 5:
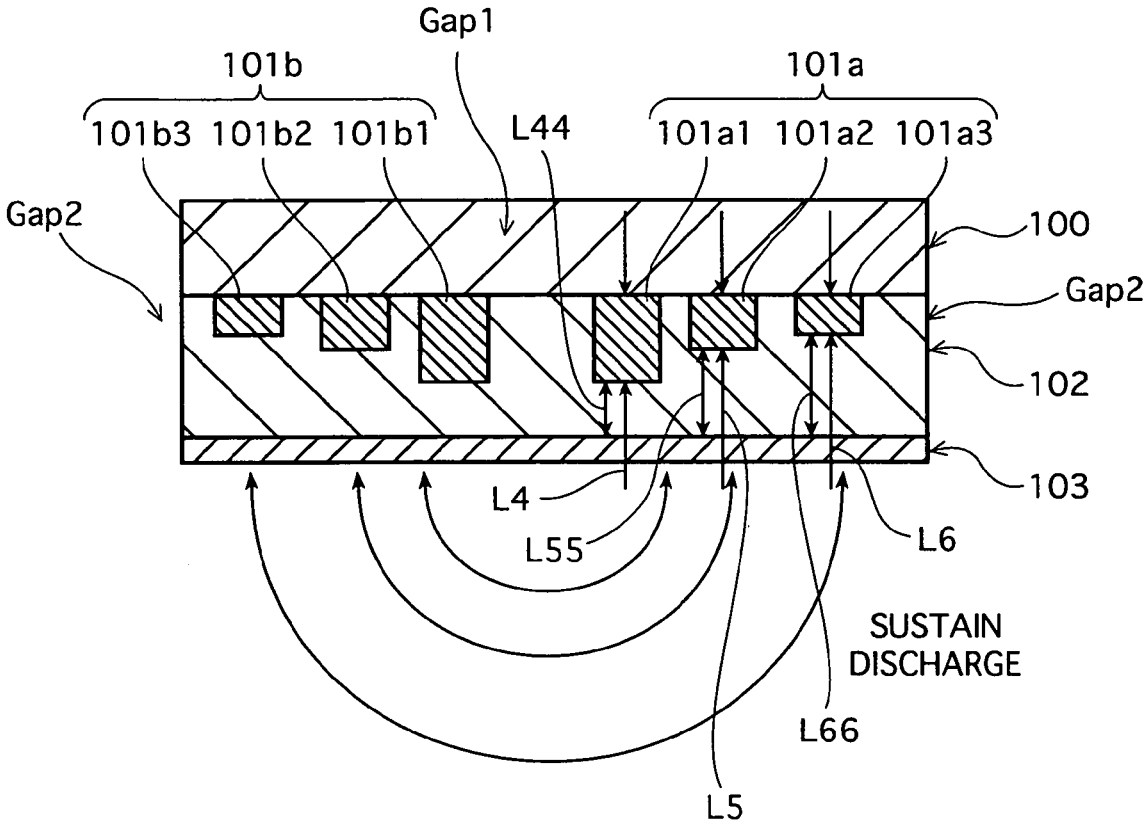
FIG. 5 is an enlarged partial cross sectional diagram of a front panel of a PDP in a second embodiment.

FIG. 5 is an enlarged partial cross-sectional diagram of the front panel (cut vertically through a center part of a cell) of the PDP of the present embodiment.

As FIG. 5 shows, the first display electrode 111*a* and the second display electrode 102*a* are composed of separate electrode lines 101*a*1, 101*a*2 and 101*a*3 and separate electrode lines 101*b*1, 101*b*2 and 101*b*3, respectively (three each in the drawing), in the stated order from the discharge gap. The separate electrode lines are separate from each other, and each has a rectangular cross-sectional shape in a direction orthogonal to the longitudinal direction. This type of electrode is called a fence electrode, and increases the scale of discharge from the discharge gap part (cell center part) towards the non-discharge gap, as well as increasing the aperture ratio of the cell.

Furthermore, the separate electrode lines 101*a*1, 101*a*2 and 101*a*3 are formed so as to have successively less respective film thicknesses L4, L5 and L6 in the stated order from the discharge gap side. Similarly, the separate electrode lines 101*b*1, 101*b*2 and 101*b*3 are also formed so as to have successively less respective film thicknesses L4, L5 and L6 in the stated order from the discharge gap side. Here, the film thicknesses satisfy a relationship L4>L5>L6.

Note that this shape can of course be easily realized using a commonly-known screen printing method, or any other method of manufacturing may be used.

Figure 6:
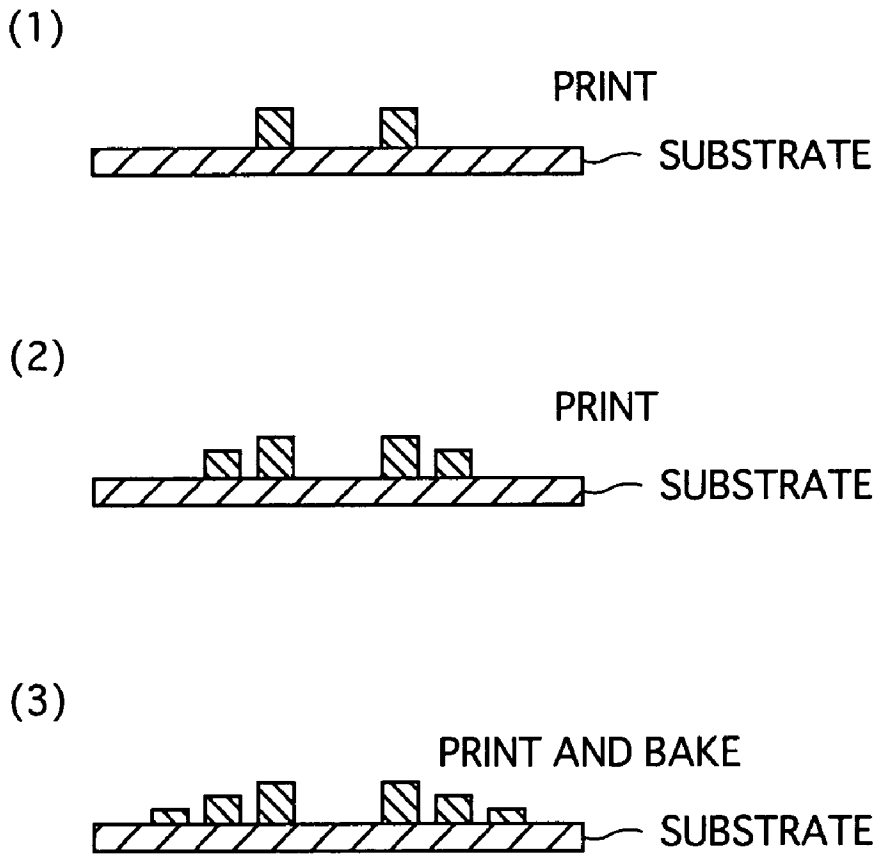
FIG. 6 shows a method for manufacturing first display electrodes and second display electrodes in the second embodiment.

According to this method, a material including metal and the like that makes up the separate electrode lines that differ in thickness is printed at predetermined intervals, as shown in (1), (2) and (3) in FIG. 6, and then baked.

Any other manufacturing method may be used.

Working and Effects

According to the described electrode structure, the dielectric glass layer 102 that is formed on the first and second display electrodes, which are scan and sustain discharge electrodes, can be made so that the equivalent film thickness in positions on each of the separate electrode lines from the respective thickest separate electrode line through to the respective thinnest separate electrode line (corresponding to L44, L55 and L66), differs (L44<L55<L66) at the discharge gap side and the side opposite thereto (the non-discharge gap side). As a result, even if the discharge gap and the non-discharge gap are geometrically equal in width, erroneous discharge in adjacent cells can be reduced by making the discharge start voltage on the discharge gap side lower than the discharge start voltage on the non-discharge gap side. This realizes an effective electrode structure that heightens definition by narrowing the non-discharge gap.

Furthermore, since each display electrode is made up of separate electrode lines, the gaps between the separate electrode lines enable the amount of emitted light reflected and absorbed by the electrodes to be reduced, and the aperture ratio of the cell is improved, thus enabling light to be brought effectively to the front of the panel.

Specific Examination of Varying the Thickness of the Separate Electrode Lines

Figure 7:
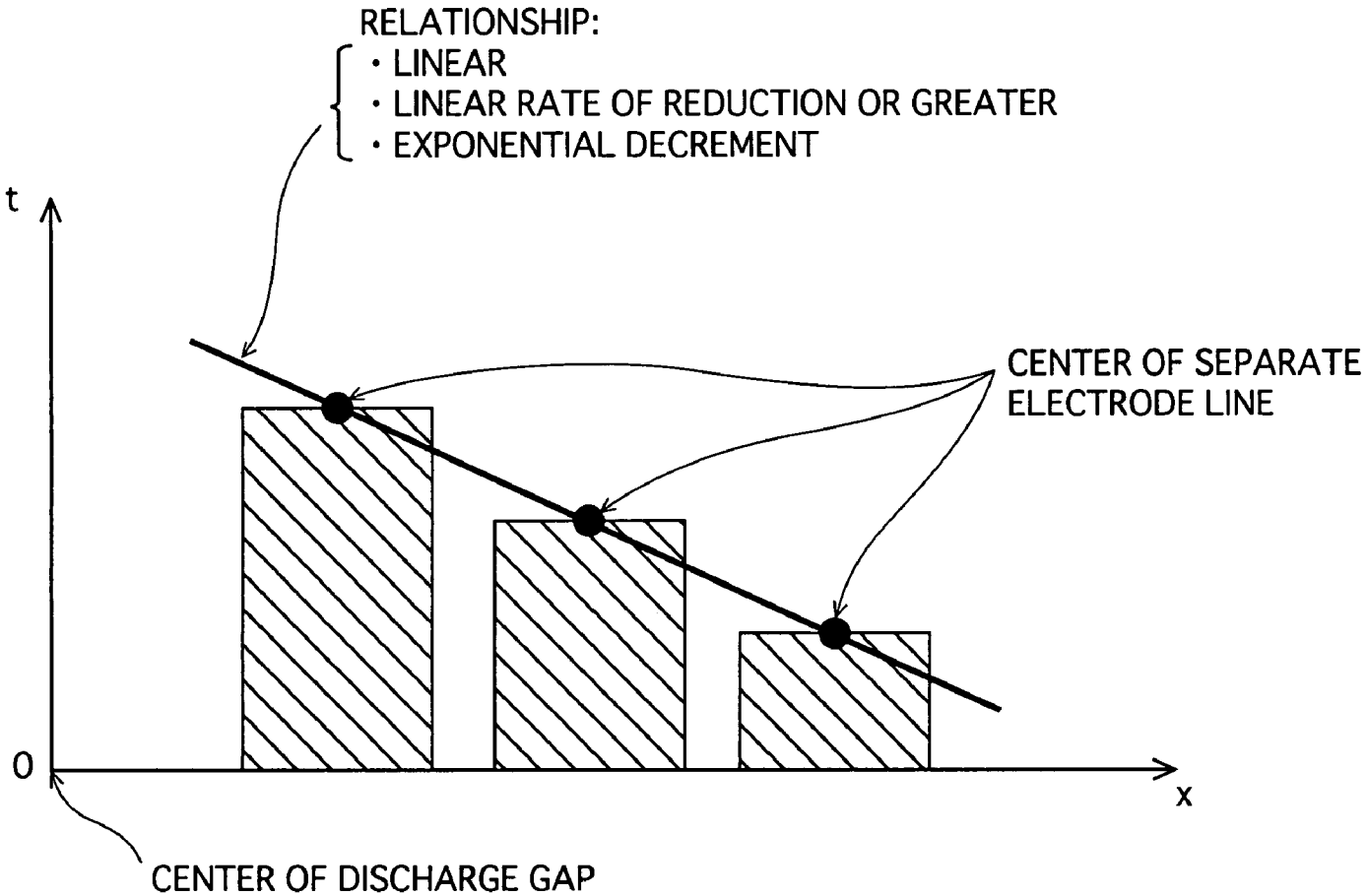
FIG. 7 describes a rate of change of film thickness of separate electrode lines, a horizontal axis (x) representing distance from a discharge gap center, and a vertical axis (t) representing a thickness of each separate electrode line.

FIG. 7 describes the rate of change of the film thickness of the separate electrode lines. The horizontal axis (x) represents the distance from the center of the discharge gap, and the vertical axis (t) represents the film thickness of each separate electrode line. As shown in FIG. 7, if correspondence between the distance from the center of the discharge gap and the film thickness of the separate electrode lines is expressed schematically, it is preferable that the rate of reduction of the film thickness of the separate electrode lines in the first and second display electrodes is equal to or greater than that shown by the straight line. Here, the correspondence between the distance from the center of the discharge gap and the thickness of the separate electrode lines becomes "equal to the straight line" by specifying in a manner represented by a linear expression ($t=-ax+b$). Furthermore, the correspondence becomes "less than the straight line" by specifying in a manner represented by an exponential such as ($t=ae^{-bx}$).

Here, it is preferable that the rate of reduction is greater than the straight line, and is an exponential rate of change.

Put another way, the rate of change being in a straight line or being exponential means the film thickness of the separate electrode lines changing linearly or non-linearly.

The essence of specifying the rate of change of the film thickness in this way is so that the difference in film thickness between the separate electrode line closest to the discharge gap and other separate electrode lines is greater towards the non-discharge gap.

The reason for specifying the rate of change of the film thickness of the separate electrode lines is as follows. Specifically, as described earlier, the electric field during discharge weakens exponentially in a direction from the discharge gap towards the non-discharge gap, and the diffusion velocity of priming particles that occur at the discharge gap side slows exponentially in proportion. Taking this and reduction of power consumption into consideration, it is appropriate to specify so that the discharge start voltage increases gradually closer towards the non-discharge gap side, by increasing the equivalent film thickness of the dielectric glass layer, in order to prevent erroneous discharge.

Furthermore, the film thickness of the separate electrode lines is specified taking into consideration the difference in electric potential between the first display electrode and the second display electrode. This is because the greater the electric potential difference, the more easily erroneous discharge occurs between adjacent cells on a line. When, for example, a pulse of 160 to 180V is applied alternately to the first display electrode and the second display electrode, a difference in film thickness of approximately 5 to 10 μm between the thickest separate electrode line adjacent to the discharge gap and the least thick separate electrode line adjacent to the non-discharge gap is effective to prevent erroneous discharge.

Specific Examination of Varying the Width of the Separate Electrode Lines

Figure 8:
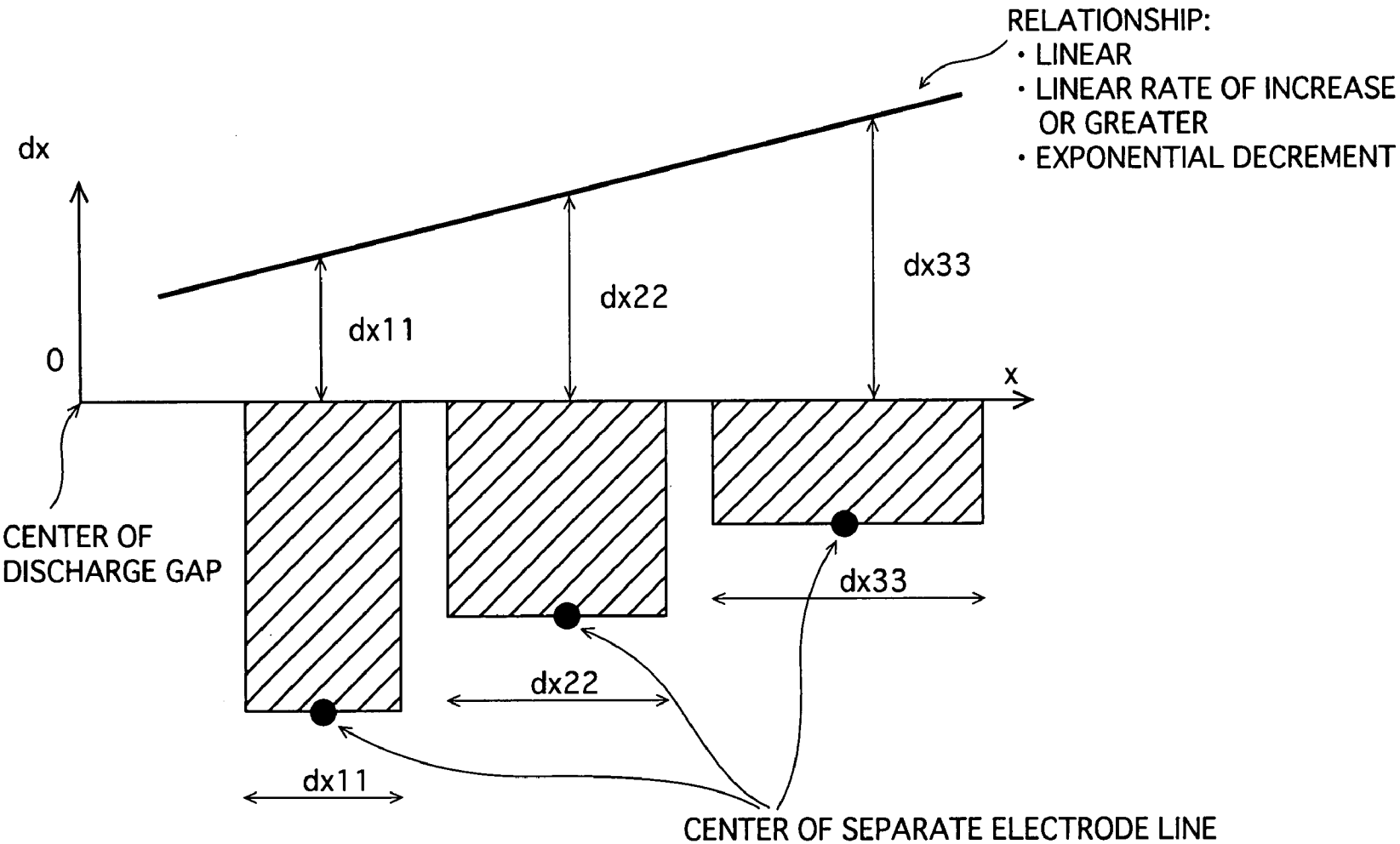
FIG. 8 describes a rate of change of width of separate electrode lines, a horizontal axis (x) representing distance from a discharge gap center, and a vertical axis (dx) representing a width of each separate electrode line.

FIG. 8 describes the rate of change of the width of the separate electrode lines. The horizontal axis (x) represents the distance from the center of the discharge gap, while the vertical axis (dx) represents the width of the separate electrode lines. As shown in FIG. 8, if correspondence between the distance from the center of the discharge gap and the width of the separate electrode lines is expressed schematically, it is preferable that the width of the respective separate electrode lines of the first display electrodes and the second display electrodes are successively larger (wider) in a direction away from the discharge gap side (satisfy a relationship dx11<dx22<dx33).

Furthermore, it is preferable that the width of the separate electrode lines increases at a rate of change that is equal to or greater than that shown by the straight line.

Put another way, the rate of change being in a straight line or being exponential denotes that the thickness of the separate electrode lines changes linearly or non-linearly.

Here, the correspondence between the distance from the center of the discharge gap and the width of the separate electrode lines is made "equal to the straight line", as shown in FIG. 4, by specifying in a manner represented by a linear expression (dx=ax+b). Furthermore, the correspondence is made "greater than the straight line" by specifying in a manner represented by an exponential such as ($dx=ae^{bx}$).

The essence of specifying the rate of change of the width in this way is so that the difference in width with the separate electrode line closest to the discharge gap is successively greater towards the non-discharge gap.

The reason for specifying width of the separate electrode lines in this way is as follows. Specifically, as described above, the electric field during discharge weakens exponentially from the discharge gap towards the non-discharge gap. Therefore, it is thought to be appropriate to specify so that the surface area of the separate electrode line of the scan and sustain discharge electrodes is successively greater towards the non-discharge gap side in order capture priming particles generated in the discharge gap side to ensure greater effective light emission surface area.

Specific Examination of Varying the Width of the Separate Electrode Lines

Figure 9:
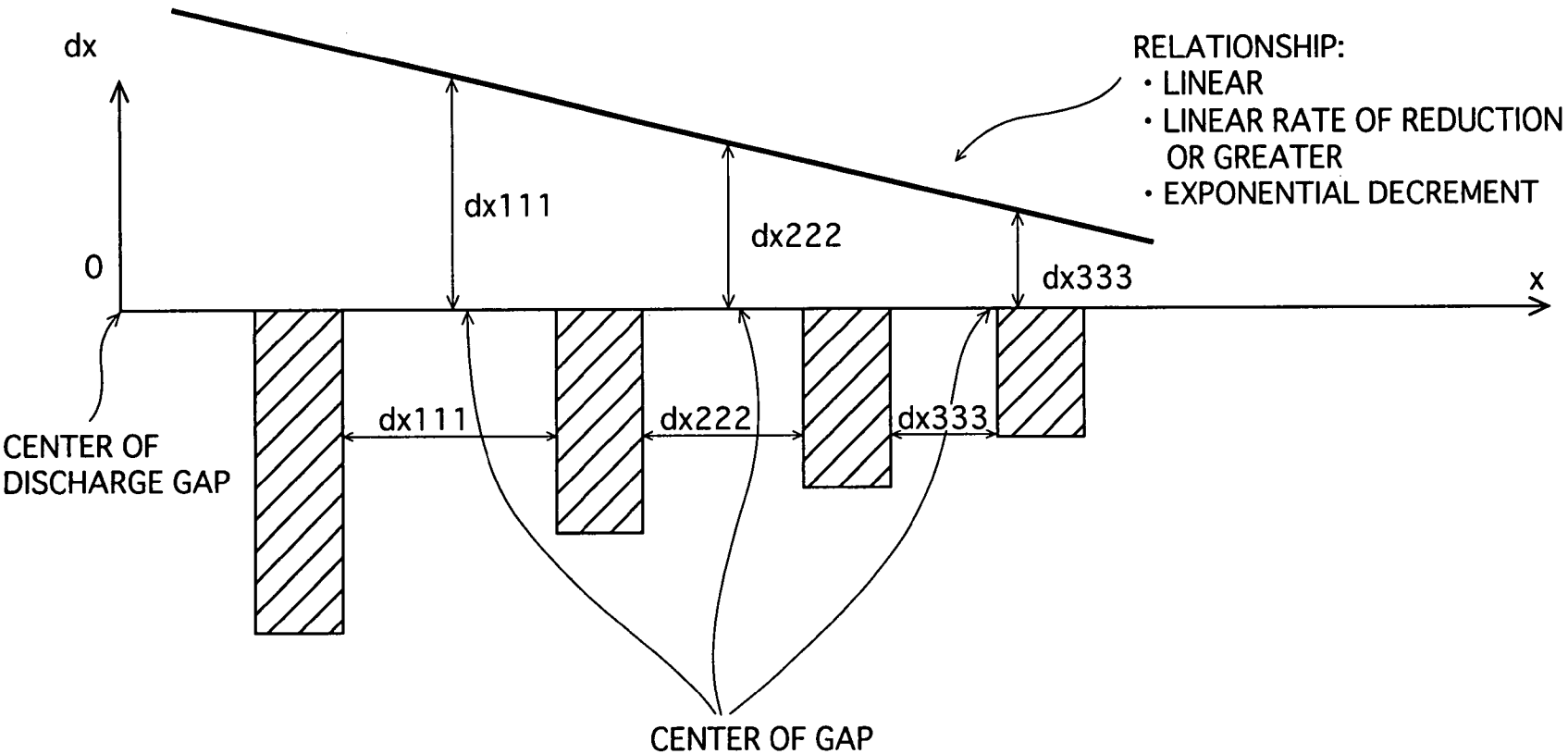
FIG. 9 describes a rate of change of a width of a discharge gap, a horizontal axis (x) representing a distance from a discharge gap center, and a vertical axis (dx) representing a width of a gap between separate electrode lines.

FIG. 9 describes the rate of change of the width of the gaps between the separate electrode lines. The horizontal axis (x) represents the distance from the center of the discharge gap, while the vertical axis (dx) represents the width of the gaps between the separate electrode lines. As shown in FIG. 9, if correspondence between the distance from the center of the discharge gap and the width of the gaps between the separate electrode lines is expressed schematically, it is preferable that, when the number of separate electrode lines in each display electrode is four or more, the width of each gap between the separate electrode lines is less the further away the gap is from the discharge gap side (satisfy a relationship dx111>dx222>dx333).

Furthermore, it is preferable that the width of the gaps between the separate electrode lines decrease at a rate of reduction that is equal to or greater than that shown by the straight line.

Furthermore, it is preferable that the rate of reduction of the width of the gaps between the separate electrode lines is greater than the straight line, and is an exponential rate of change.

Put another way, the rate of change being in a straight line or being exponential denotes that the width of the separate electrode lines changes linearly or non-linearly.

Here, the correspondence between the distance from the center of the discharge gap and the width of the gaps between the separate electrode lines is made "equal to the straight line", as shown in FIG. 9, by specifying in a manner represented by a linear expression (dx=−ax+b). Furthermore, the correspondence is made "greater than the straight line" by specifying in a manner represented by an exponential such as ($dx=ae^{-bx}$).

The essence of specifying the rate of change of the width of the gaps between the separate electrode lines in this way is so that the difference in width of the gaps with the gap closest to the discharge gap is successively greater towards the non-discharge gap.

The reason for specifying width of the gaps between the separate electrode lines is as follows. Specifically, as described above, the electric field during discharge weakens exponentially from the discharge gap towards the non-discharge gap and brightness of emitted light decreases in proportion. Therefore, it is thought to be appropriate to specify so that the width of the gaps between the separate electrode lines decreases successively towards the non-discharge gap side in order to capture priming particles generated in the discharge gap side to ensure greater effective light emission surface area.

State of Connection of Separate Electrode Lines

Figure 10:
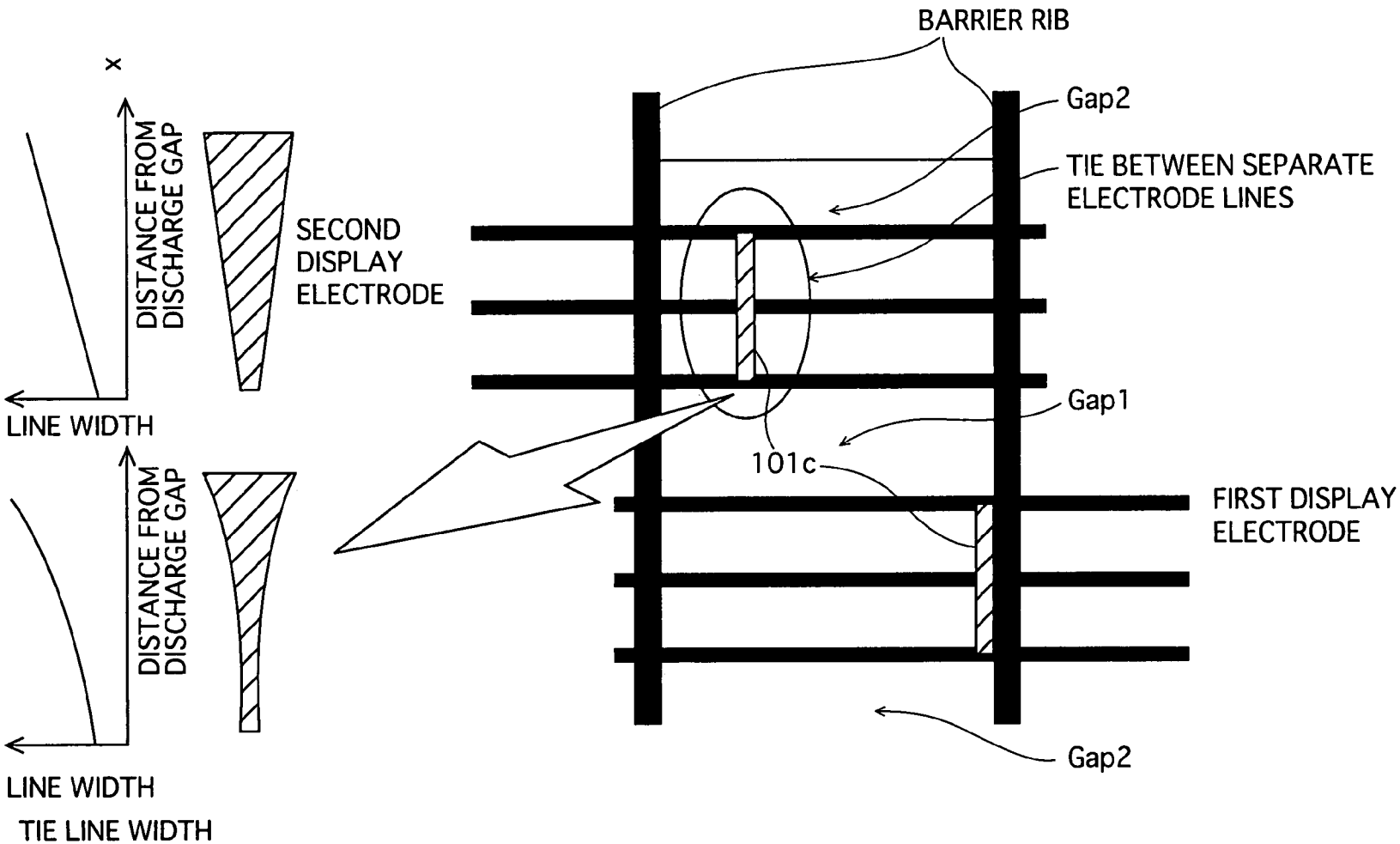
FIG. 10 shows how separate electrode lines are connected in the second embodiment.

In the above-described display electrode structure each set of separate electrode lines merges at the edges of the panel and are connected to a driving circuit as one line, as shown in FIG. 10 (a plan view showing the structure of a first display electrodes and a second display electrode). In order to prevent the lines from breaking during patterning, it is preferable that separate electrode lines that drive with the same phase (polarity) are connected by a dielectric matter (connection line 101*c*).

It is preferable to provide at least one connection line in each cell from a point of view of reducing resistance.

Here, it is preferable to provide the connection lines close to the positions of the barrier ribs in the gas discharge panel in order to increase the aperture ratio of the cells. Furthermore, it is preferable to wire the connection lines in positions corresponding to the positions of the barrier ribs, to further increase the aperture ratio of the cells.

Here, it is preferable that the width of the connection lines in a direction along the display electrodes gradually increases away from the discharge gap.

Here, it is preferable that the rate of increase of width of the connection line in the direction along the display electrodes is equal to or greater than that shown by the straight line.

Here, it is preferable, when the rate of increase of the width of the connection line in the direction along the display electrodes is greater than the straight line, that the rate of reduction be an exponential rate of change.

Put another way, the rate of change being in a straight line or being exponential denotes that the width of the connection line changes linearly or non-linearly.

The essence of specifying the rate of change of the width of the connection lines in this way is so that the difference between the width of the connection line near the discharge gap and other parts of the connection line increases towards the non-discharge gap.

The reason for this is that the electric field during discharge weakens exponentially in a direction from the discharge gap towards the non-discharge gap, and the diffusion velocity of priming particles that occur at the discharge gap side slows exponentially in proportion. Taking this and reduction of power consumption into consideration, it is appropriate to specify so that the discharge start voltage increases gradually towards the non-discharge gap side, by increasing the equivalent film thickness of the dielectric glass layer, in order to prevent erroneous discharge.

Furthermore, since the electric field during discharge weakens exponentially in a direction from the discharge gap to the non-discharge gap, and the brightness of emitted light lessens proportionally, it is appropriate to specify so that the cell aperture ratio increases towards the discharge gap side, in order to improve brightness.

Furthermore, from the point of view of reducing power consumption, it is preferable that the thickness of the connector is the same as that of the thinnest of the separate electrode lines having the same polarity. This reduces the amount of unnecessary static electricity.

Figure 11:
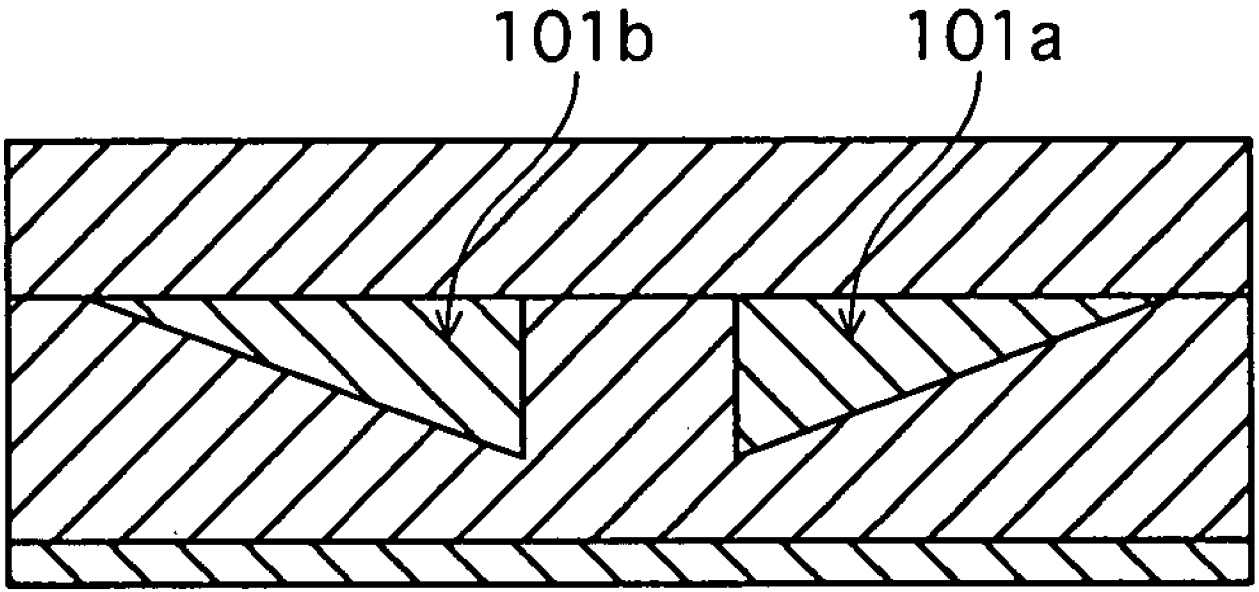
FIG. 11 is plan view showing the structure of first display electrodes and second display electrodes in an example of a modification.
Figure 12:
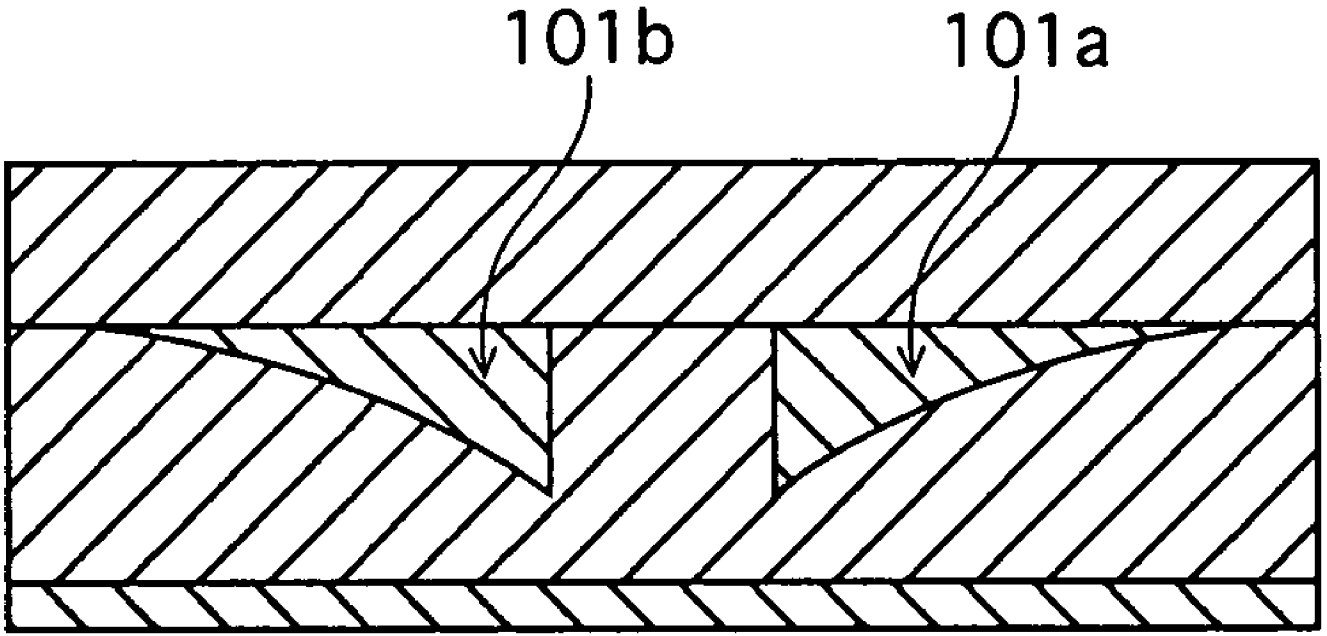
FIG. 12 is plan view showing the structure of first display electrodes and second display electrodes in an example of a modification.
Figure 13:
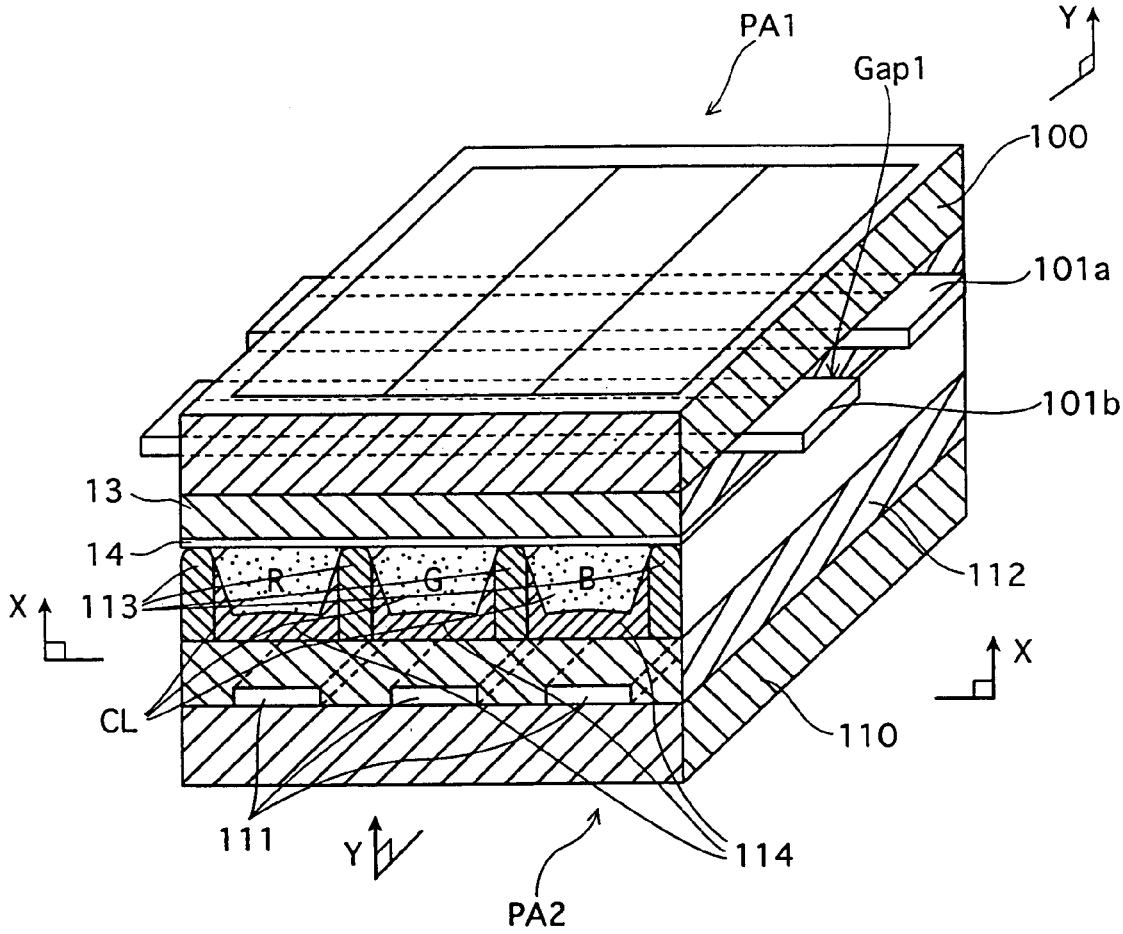
FIG.13 PRIOR ART
FIG. 13 is a perspective diagram showing relevant parts of the structure of a PDP common to the prior art and the preferred embodiments of the present invention.
Figure 14:
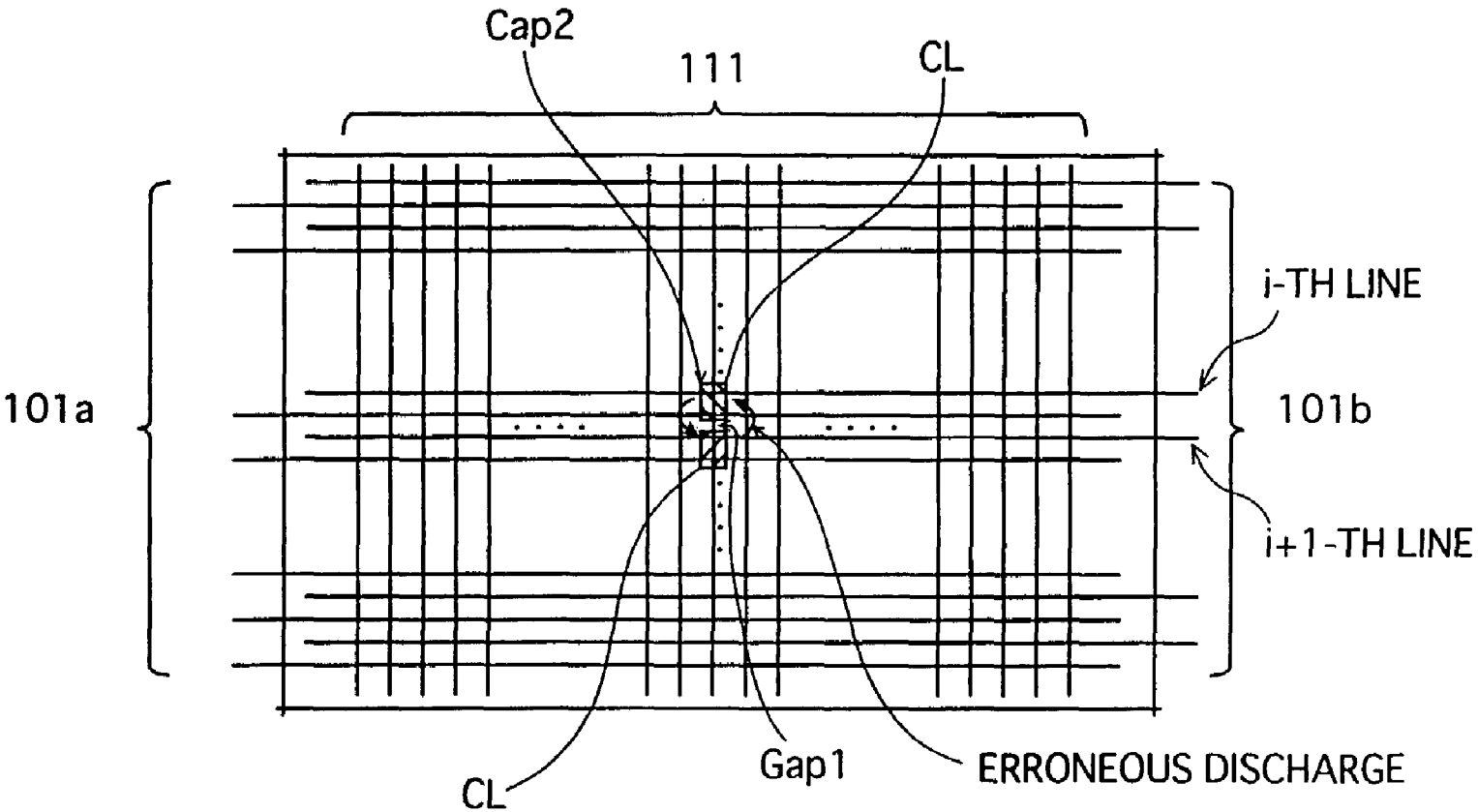
FIG. 14 PRIOR ART
FIG. 14 is a plan view showing positioning of display electrodes.

Note that in the first embodiment, the first display electrodes and the second display electrodes are not limited to having the described stepped shape. Specifically, as long as the equivalent film thickness of the dielectric glass layer 102 formed on the first display electrodes and the second display electrodes, which are scan and sustain electrodes, can be made in differing states at the discharge gap side and the non-discharge gap side, erroneous discharge between adjacent lines can be reduced by making the discharge start voltage of the discharge gap side lower than that on the non-discharge gap side, even if the discharge gap and the non-discharge gap have the same width geometrically. To this end, it is sufficient for the electrode thickness on the discharge gap side to be greater than that on the non-discharge gap side. The shapes shown in FIG. 11 (triangle-shaped discharge electrodes whose film thickness changes linearly from the discharge gap side towards the non-discharge gap side) and FIG. 12 (discharge electrodes having a curved surface and whose film thickness changes exponentially from the discharge gap side towards the non-discharge gap side) are possible shapes.

Furthermore, it is not necessary for both the first display electrodes and the second display electrodes to have a stepped shape structure and a rectangular shaped structure. One of these shapes is sufficient. Furthermore, although the display electrodes are described as being formed of metal in the embodiments, they may of course be formed from a metal oxide such ITO.

Note that the present invention is not limited to the described embodiments, and anything that has the same working and effects is included in the category of the technical concept of the present invention.

For example, although both the first display electrodes and the second display electrodes have the characteristic shapes in the described embodiments, it is acceptable for either the first display electrodes or the second display electrodes to have such a cross-sectional shape.

Furthermore, it is not necessary for each of the stripe-pattern first display electrodes and second display electrodes to have the same cross-sectional shape uniformly along the electrode as described in the embodiments. It is sufficient that each electrode has the described pattern at least at parts that fall inside the cells. This is because this structure achieves an effect of preventing main discharge in cells from spreading to adjacent cells on an adjacent line.

Furthermore, although an example of a gas discharge panel having a front panel and a back panel sealed together is described in the embodiments, it is possible to manufacture the front panel with display electrodes having one of the described characteristic shapes (stepped shape or separate electrode lines), and seal this panel together with a back panel that has be manufactured in advance.

As described, according to the gas discharge panel of the present invention, by distributing the thickness to improve the structure of scan and sustain discharge electrodes, the equivalent film thickness of the dielectric glass layer, which is a trade-off with the thickness of the electrodes, is also distributed, thus enabling the discharge start potential at the discharge gap side and the non-discharge gap side of the scan and sustain discharge electrodes to differ, even if the gaps between the scan and sustain discharge electrodes are the same geometrically. This has a remarkable effect of preventing erroneous discharge between adjacent lines, even if the non-discharge gap is narrowed in order to heighten definition.

Industrial Use

The present invention enables stable discharge in a display apparatus, such as a plasma display panel, by preventing erroneous discharge between adjacent lines, and therefore has remarkably high usage value in terms of enabling high quality image display.

The invention claimed is:

1. A panel that executes discharge in each of a plurality of cells positioned on a pair of discharge electrodes, by applying voltage between the discharge electrodes, wherein in at least one cell, at least one of the discharge electrodes has a stepped shape in a cross-sectional view in a direction orthogonal to a longitudinal direction of the discharge electrodes, the stepped shape having at least three steps, and in the stepped shape any given step that is closer to a discharge gap than another step is thicker than the other step.

2. The panel of claim 1, wherein difference in thickness between (i) any given step that has a neighboring step on a discharge-gap side and (ii) the neighboring step is greater as a distance becomes further from the discharge gap.

3. The panel of claim 2, wherein the steps successively increase in width, the widest being furthest from the discharge gap.

4. The panel of claim 1, wherein the steps successively increase in width, the widest being furthest from the discharge gap.

5. The panel of claim 4, wherein difference in width between (i) any given step that has a neighboring step on the discharge-gap side and (ii) the neighboring step is greater as a distance becomes further from the discharge gap.

6. A panel that executes discharge in each of a plurality of cells positioned on a pair of discharge electrodes, by applying voltage between the discharge electrodes, wherein in at least one cell, at least one discharge electrode is composed of at least three separate electrode lines in which any given electrode line that is closer to a discharge gap than another electrode line is thicker than the other electrode line.

7. The panel of claim 6, wherein difference in thickness between (i) any given electrode line that has a neighboring electrode line on a discharge-gap side and (ii) the neighboring electrode line is greater as a distance becomes further from the discharge gap.

8. The panel of claim 7, wherein the electrode lines successively increase in width, the widest being the furthest from the discharge gap.

9. The panel of claim 6, wherein the electrode lines successively increase in width, the widest being the furthest from the discharge gap.

10. The panel of claim 9, wherein difference in width between (i) any given electrode line that has a neighboring electrode line on the discharge-gap side and (ii) the neighboring electrode line is greater as a distance becomes further from discharge gap.

11. The panel of claim 6, wherein separate electrode lines in a same cell that have a same polarity are electrically connected by a connector that is wired at a predetermined interval.

12. The panel of claim 11, wherein the connector is wired so as to correspond to a position of a barrier rib in the panel.

13. The panel of claim 12, wherein the connector increases in width in a direction parallel with the discharge electrodes, a widest part being furthest from the discharge gap.

14. The panel of claim 11, wherein the connector increases in width in a direction parallel with the discharge electrodes, a widest part being furthest from the discharge gap.

15. The panel of claim 14, wherein difference in width between (i) any given part of the connector that has a neighboring part on a discharge-gap side and (ii) the neighboring part is greater as a distance becomes further from the discharge gap.

16. The panel of claim 11, wherein a thickness of the connector is equal to a thickness of a thinnest of the separate electrode lines having the same polarity as the connector.

17. The panel of claim 6, wherein gaps between the separate electrode lines are successively greater in width, a narrowest gap being furthest from the discharge gap.

18. The panel of claim 17, wherein difference in width between (i) any given gap between electrode lines that has a neighboring gap between electrode lines on a discharge-gap side and (ii) the neighboring gap between electrode lines is greater as a distance becomes further from the discharge gap.

* * * * *